US011728587B2

(12) United States Patent
Roehr et al.

(10) Patent No.: US 11,728,587 B2
(45) Date of Patent: Aug. 15, 2023

(54) FLAT PLUG-IN CONNECTOR ARRANGEMENT AND FLAT CONTACT FOR THE FLAT PLUG-IN CONNECTOR ARRANGEMENT

(71) Applicant: KOSTAL Automobil Elektrik GmbH & Co. KG, Luedenscheid (DE)

(72) Inventors: Michael Roehr, Dortmund (DE); Till Ringel, Essen (DE); Philip Babczynski, Dortmund (DE)

(73) Assignee: KOSTAL Automobil Elektrik GmbH & Co. KG, Luedenscheid (DE)

( * ) Notice: Subject to any disclaimer, the term of this patent is extended or adjusted under 35 U.S.C. 154(b) by 273 days.

(21) Appl. No.: 17/325,541

(22) Filed: May 20, 2021

(65) Prior Publication Data

US 2021/0273365 A1 Sep. 2, 2021

Related U.S. Application Data

(63) Continuation of application No. PCT/EP2019/084976, filed on Dec. 12, 2019.

(30) Foreign Application Priority Data

Dec. 17, 2018 (DE) ..... 10 2018 009 921.1

(51) Int. Cl.
*H01R 13/17* (2006.01)
*H01R 13/24* (2006.01)
(Continued)

(52) U.S. Cl.
CPC ..... *H01R 13/17* (2013.01); *H01R 13/2428* (2013.01); *H01R 13/508* (2013.01); *H01R 13/533* (2013.01)

(58) Field of Classification Search
CPC .. H01R 13/17; H01R 13/2428; H01R 13/508; H01R 13/533; H01R 13/04; H01R 13/428; H01R 13/112; H01R 13/08
See application file for complete search history.

(56) References Cited

U.S. PATENT DOCUMENTS 4,353,609 A 10/1982 Haas
4,561,712 A * 12/1985 Borne ..... H01R 13/112 439/223

(Continued)

FOREIGN PATENT DOCUMENTS

DE 4200109 A1 7/1993
DE 29906652 U1 8/2000

(Continued)

OTHER PUBLICATIONS

Machine translation DE-102011083776-A1, (Apr. 4, 2013) (Year: 2023).*

(Continued)

*Primary Examiner* — Travis S Chambers
(74) *Attorney, Agent, or Firm* — Brooks Kushman P.C.

(57) ABSTRACT

A flat plug-in connector assembly includes a flat contact, a mating plug connector, and a contact chamber. The flat contact has a middle strip having opposite first and second sides and further has a first end that forms a blade contact section. The mating plug connector includes a pair of contact springs for accommodating the blade contact section. The flat contact further includes first and second spring arms for damping relative movements between the blade contact section and the contact springs. The first and second spring arms are integrally formed in one piece at the first and second sides of the flat contact. The first and second spring arms have first and second free end sections in a form of first and second detent hooks. The flat contact is inserted in the (Continued)

contact chamber with the first and second detent hooks being displaceable supported in the contact chamber.

20 Claims, 3 Drawing Sheets

(51) Int. Cl.
*H01R 13/508* (2006.01)
*H01R 13/533* (2006.01)

(56) References Cited

U.S. PATENT DOCUMENTS 5,445,541 A 8/1995 May et al.
5,556,308 A * 9/1996 Brown ..... H01R 12/58 439/82
5,562,485 A * 10/1996 Hoyte ..... H01R 13/6273 439/489
5,997,347 A * 12/1999 Robinson ..... H01R 13/426 439/747
2001/0041467 A1 11/2001 Kikuchi et al.

FOREIGN PATENT DOCUMENTS

DE 102011076506 A1 11/2012
DE 102011083776 A1 * 4/2013 ..... H01R 12/57
DE 102016200243 A1 * 7/2017
TW 200937761 A * 9/2009

OTHER PUBLICATIONS

Machine translation DE-102016200243-A1, (Jul. 13, 2017) (Year: 2023).*
Machine translation TW-200937761-A, (Sep. 1, 2009) (Year: 2023).*
European Patent Office, International Search Report for International Application No. PCT/EP2019/084976, dated Apr. 23, 2020.
German Patent and Trademark Office, German Search Report for German Patent Application No. 10 2018 009 921.1, dated Aug. 20, 2019.
The International Bureau of WIPO, International Preliminary Report on Patentability for International Application No. PCT/EP2019/084976, dated Jun. 16, 2021.

* cited by examiner

FLAT PLUG-IN CONNECTOR ARRANGEMENT AND FLAT CONTACT FOR THE FLAT PLUG-IN CONNECTOR ARRANGEMENT

CROSS-REFERENCE TO RELATED APPLICATIONS

This application is a continuation of International Application No. PCT/EP2019/084976, published in German, with an International filing date of Dec. 12, 2019, which claims priority to DE 10 2018 009 921.1, filed Dec. 17, 2018, the disclosures of which are hereby incorporated in their entirety by reference herein.

TECHNICAL FIELD

The present invention relates to a flat plug-in (or "plug") connector assembly including a flat contact which has a blade contact section, a mating plug connector which has a pair of contact springs that are suitable for accommodating the blade contact section, and spring arms for damping relative movements between the blade contact section of the flat contact and the contact springs of the mating plug connector. The present invention further relates to a flat contact for this flat plug-in connector assembly.

BACKGROUND

Many electrical plug connectors, which may be designed as flat contacts, for example, are used under harsh environmental conditions. When plug connectors are used in motor vehicles, for example, they are often exposed not only to changing temperatures, but also corrosive gases and vapors as well as vibration stresses.

Relative movements between mutually connected contacts result from vibrations on the one hand, and thermal linear expansions due to changing temperatures on the other hand. The phenomenon of friction corrosion is known. Due to relative movements of the contacts of mutually connected plug connector parts against one another, the contact surfaces are subjected to mechanical load and, under appropriate environmental conditions, chemical stress and attacks. This results in impairment of the electrical properties of the contacts, often to the point of functional failure.

A plug connector assembly made up of a flat contact in the form of a blade contact section and a socket-like spring arm contact element is known from German utility patent DE 299 06 652 U1. Coupled to the spring contact arms of the spring arm contact element that contact the flat contact are spring legs of a mechanically stiff over-spring. The spring legs of the over-spring additionally hold the flat contact clamped, and which are thus intended to prevent relative movements, caused by external vibrations, between the flat contact and the spring contact arms of the spring arm contact element.

As a result of the provided over-spring, the measures provided here on the socket side for preventing relative movements between the contact elements, and thus friction corrosion, require at least a two-part design of the spring arm contact element, and thus entail relatively high costs and installation effort.

SUMMARY

An object is to provide a particularly simple and economical flat plug-in connector assembly that has little susceptibility to friction corrosion.

Another object is to provide a flat contact that has a particularly advantageous design.

An embodiment provides a flat plug-in (or plug) connector arrangement. The flat plug-in connector arrangement includes a flat contact which has a blade contact section, a mating plug-in connector which has a pair of contact springs suitable for receiving the blade contact section, and spring arms for damping relative movements between the blade contact section of the flat contact and the contact springs of the mating plug-in connector. The spring arms are integrally formed on the long narrow sides of the flat contact. End sections of the spring arms are designed as latching, locking, or detent hooks ("detent hooks"). The end sections of the spring arms are displaceable mounted in a contact chamber. A flat contact is advantageously designed for this flat plug-in connector arrangement.

In carrying out at least one of the above objects and/or other objects, a flat plug-in connector arrangement is provided. The flat plug-in connector arrangement includes a flat contact, a mating plug connector, and a contact chamber. The flat contact has a middle strip having opposite first and second sides and a first end that forms a blade contact section. The mating plug connector includes a pair of contact springs for accommodating the blade contact section. The flat contact further includes first and second spring arms for damping relative movements between the blade contact section and the contact springs. The first and second spring arms are integrally formed in one piece at the first and second sides of the flat contact, respectively. The first and second spring arms have first and second free end sections in a form of first and second detent hooks. The flat contact is inserted in the contact chamber with the first and second detent hooks being displaceable supported in the contact chamber.

In embodiments, at least one of the above objects and/or other objects is achieved in that the spring arms are integrally formed in one piece at the long narrow sides of the flat contact, and the end sections of the spring arms, designed as detent hooks, are displaceable supported (i.e., slidably mounted) in the contact chamber.

The flat contact provided for the flat plug-in connector assembly according to embodiments of the present invention includes a pair of integrally formed (e.g., molded) spring arms that are able to compensate for vibrations acting on the flat contact in the longitudinal direction and also in the two transverse directions.

The spring arms allow movements in the longitudinal direction in order to compensate for relative movements in the longitudinal direction. In addition, the spring arms allow a wobbling or tumbling movement that is suitable for relieving stress on the solder joints of the mating contact.

At the same time, the flat contact advantageously meets the following requirements:

- Good conduction of electric current;
- Compensation for linear expansions and vibrations of the overall system so that these do not displace or shift the contact point and result in damage to the contact point due to friction corrosion;
- Minimization of forces that continually develop at solder joints (which may be implemented using THT or SMD technology) of the contact partner of the flat contact, and that may result in stress and damage to these solder joints over time;
- Compensation for tolerances of the overall system so that these do not result in action of force on the contact partner of the flat contact and its solder joints;

Positioning of the flat contact with respect to the contact partner during the plug-in operation; and Simple installation of the flat contact.

The flat contact is installed by insertion into a contact chamber. The contact chamber may be part of a plug connector housing or a device housing. The contact chamber has latching, locking, or detent recesses ("detent recesses") formed therein. The end sections of the spring arms, which are designed as detent hooks, engage with the detent recesses formed in the contact chamber. The flat contact is preferably only mechanically connected to the contact chamber via the detent hooks of the spring arms of the flat contact.

In the installed (i.e., assembled) state, the flat contact is situated in a middle or central position within the contact chamber. This allows movement and thus positioning of the flat contact relative to the contact chamber, and also relative to the contact partner of the flat contact. The contact partner of the flat contact may in particular be designed as a fork contact. The flat contact reduces tolerances and forces due to torsion and bending of the spring arms within the contact chamber.

The flat contact is thus movably supported in the contact chamber after installation. When a vibration source acts on the contact chamber, the mechanical inertia of the flat contact and the spring action of the spring arms result in only a damped transmission of vibrations from the contact chamber to the blade contact element of the flat contact. Thus, even under mechanical vibration stresses, there is no appreciable displacement of the contact elements relative to one another that could cause damage to the contact point.

It is advantageous for the detent recesses along the longitudinal direction of the contact chamber to have a larger design than the detent hooks of the spring arms, thus forming free spaces in which the detent hooks are movably situated in the longitudinal direction of the contact chamber.

It is advantageous that the blade contact section is situated in a setpoint position, and with a slight counterforce may be deflected by the insertion bevels of the mating contact. Stresses in the solder joints are caused by tolerances of the structure, the flat contact, and the mating contact.

BRIEF DESCRIPTION OF THE DRAWINGS

A flat plug connector assembly designed according to embodiments of the present invention and an advantageously designed flat contact of such a flat plug connector assembly are explained in greater detail below with reference to the Figures, which show the following.

DETAILED DESCRIPTION

Detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
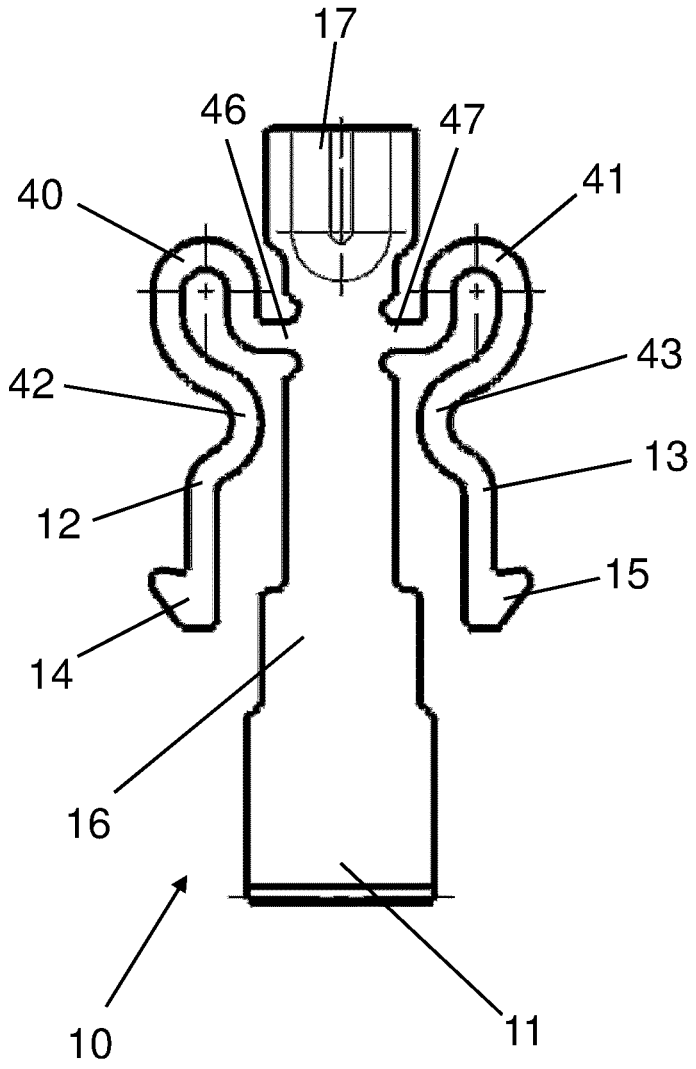
FIG. 1 shows a top view of a flat contact in accordance with an embodiment of the present invention.
Figure 2:
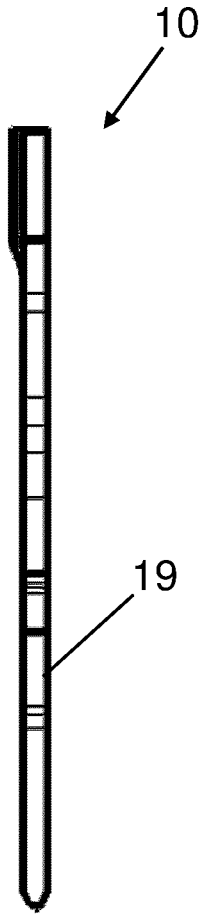
FIG. 2 shows a side view of the flat contact.

Referring now to FIGS. 1 and 2, a flat contact 10 in accordance with an embodiment of the present invention is shown. FIG. 1 shows a top view of flat contact 10 and FIG. 2 shows a side view of flat contact 10.

FIG. 2 illustrates via the side view that flat contact 10 has an overall flat design. That is, flat contact 10, as a whole, has a planar structure. Therefore, flat contact 10 may be easily punched from a flat piece of sheet metal in one work operation without the need for additional work steps such as bending operations. Flat contact 10 may thus be manufactured in an extremely cost-effective manner.

As shown in FIGS. 1 and 2, flat contact 10 is a one-piece flat contact. Flat contact 10 includes a central flat metal strip 16. One end section of metal strip 16 forms a blade contact 11. The other end section of metal strip 16 forms a line contacting section 17. Line contacting section 17 may have various designs, and in particular may form a crimp, solder, weld, or another blade contact section.

Flat contact 10 further includes first and second arms 12 and 13. Spring arms 12, 13 are molded onto the two long, narrow sides 19 of metal strip 16 at respective attachment sites (or molding points) 46, 47. Attachment sites 46, 47 are preferably situated at the same height with one another relative to the longitudinal direction of metal strip 16. Spring arms 12, 13 are preferably formed and situated mirror-symmetrically with respect to the longitudinal axis of metal strip 16.

The free end sections of spring arms 12, 13 have latching or detent hooks ("detent hooks") 14, 15, respectively. Detent hook 14 is integrally formed in one piece with spring arm 12; and detent hook 15 is integrally formed in one piece with spring arm 13.

Spring arm 12 has multiple rounded areas between attachment site 46 and detent hook 14 such that its extension direction changes multiple times. In this regard, in the illustrated embodiment, spring arm 12 forms at least two bend-like curves 40, 42 in succession. Due to these multiple bend-like curves 40, 42, spring arm 12 as a whole extends substantially parallel to the longitudinal axis of metal strip 16.

Likewise, spring arm 13 has multiple rounded areas between attachment site 47 and detent hook 15 such that its extension direction changes multiple times. In this regard, in the illustrated embodiment, spring arm 13 forms at least two bend-like curves 41, 43 in succession. Due to these multiple bend-like curves 41, 43, spring arm 13 as a whole extends substantially parallel to the longitudinal axis of metal strip 16.

Figure 3:
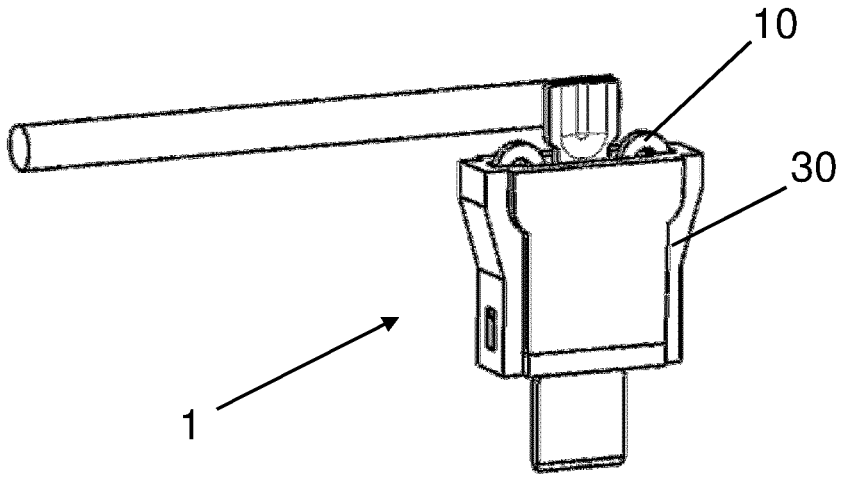
FIG. 3 shows a flat plug connector that includes the flat contact in accordance with an embodiment of the present invention.
Figure 4:
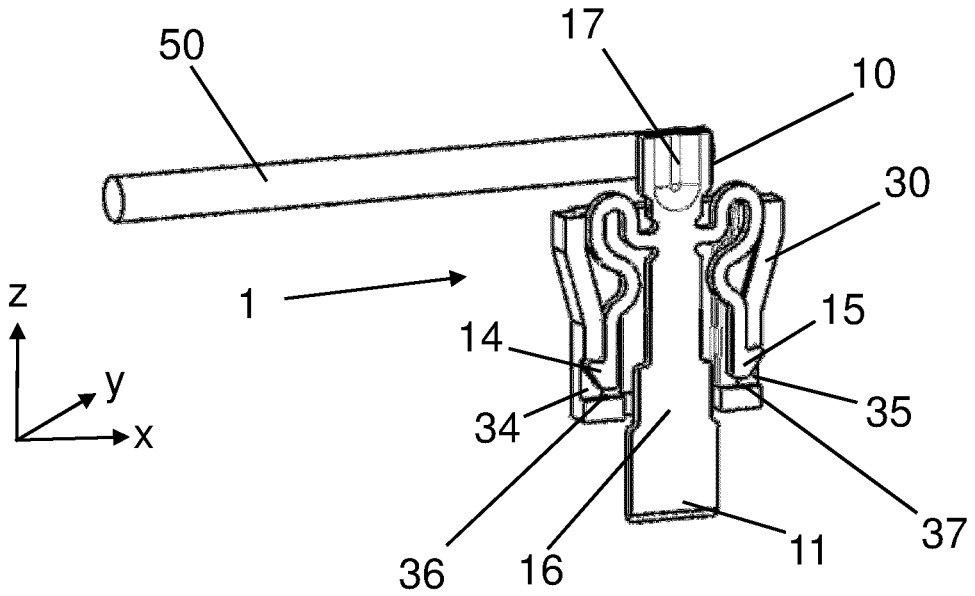
FIG. 4 shows a sectional view of the flat plug connector.

Referring now to FIGS. 3 and 4, with continual reference to FIGS. 1 and 2, a flat plug connector 1 that includes flat contact 10 in accordance with an embodiment of the present invention is shown. Flat plug connector 1 includes a contact chamber 30. For manufacturing flat plug connector 1, flat contact 10 is inserted into a contact chamber 30, resulting in the installed state illustrated in FIG. 3 and shown more clearly in the sectional view of FIG. 4. In this installation step, flat contact 10 may already have an electrically and mechanically attached connection line 50.

Contact chamber 30 is used for holding flat contact 10. Contact chamber 30 may in particular be part of a plug connector housing or a device housing (not illustrated here in greater detail).

As shown in FIG. 4, flat contact 10 is in contact chamber 30 with detent hooks 14, 15 of spring arms 12, 13 being inserted into detent recesses 34, 35 of contact chamber 30. Contact chamber 30 is designed in such a way that central metal strip 16 of flat contact 10 does not contact or touch the inner walls of contact chamber 30 and is thus movable and tiltable in multiple directions against the force of spring arms 12, 13. As a result, the effects of spring arms 12, 13 acting on contact chamber 30 are mitigated, so that some external vibrations are no longer transmitted, or at least are transmitted with significant reduction, to blade contact section 11 of flat contact 10.

As noted, detent hooks 14, 15 of spring arms 12, 13 are inserted into detent recesses 34, 35 of contact chamber 30 when flat contact 10 is in contact chamber 30. Detent recesses 34, 35 of contact chamber 30 in the longitudinal direction of spring arms 12, 13 have a slightly larger design than detent hooks 14, 15 of spring arms 12, 13. As such, when detent hook 14 of spring arm 12 is inserted into detent recess 34 of contact chamber 30, a free space 36 still remains in detent recess 34. Detent hook 14 of spring arm 12 may move within free space 36 along the z-direction, illustrated by a coordinate trihedral. Likewise, when detent hook 15 of spring arm 13 is inserted into detent recess 35 of contact chamber 30, a free space 37 still remains in detent recess 35. Detent hook 15 of spring arm 13 may move within free space 37 along the z-direction, illustrated by the coordinate trihedral. The capability of detent hooks 14, 15 of spring arms 12, 13 being able to move within free spaces 36, 37 along the z-direction is advantageous, since spring arms 12, 13 have a more rigid design in the z-direction than in the x- and y-directions. Therefore, in the x-direction and the y-direction, spring arms 12, 13 may compensate for movements of metal strip 16 relative to contact chamber 30 in a resilient or elastic manner.

Figure 5:
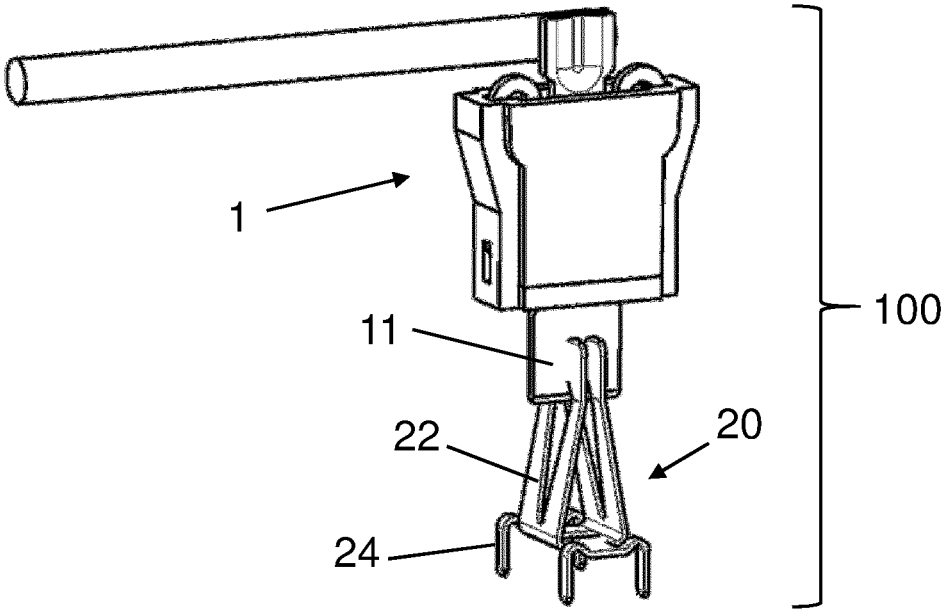
FIG. 5 shows a flat plug connector assembly in accordance with an embodiment of the present invention.
Figure 6:
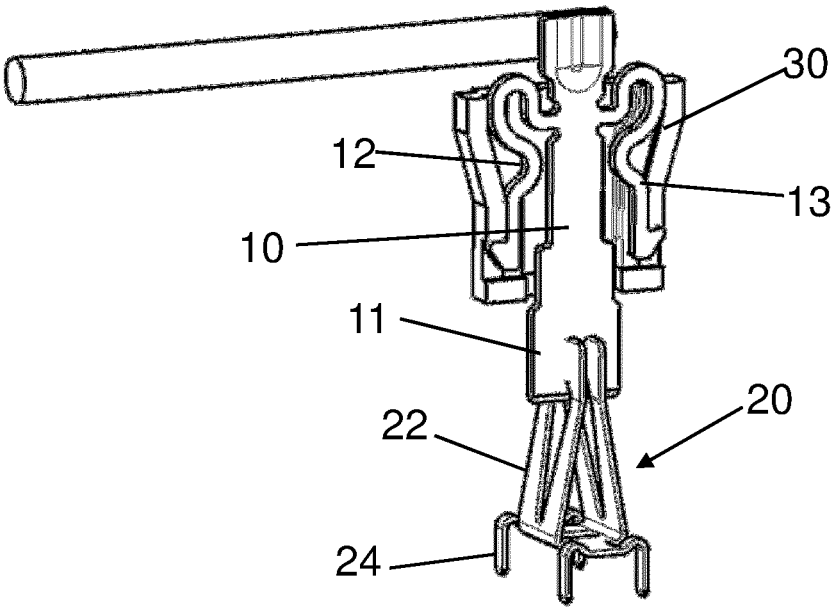
FIG. 6 shows a sectional view of the flat plug connector assembly.

Referring now to FIGS. 5 and 6, within continual reference to FIGS. 1, 2, 3, and 4, a flat plug connector assembly 100 in accordance with an embodiment of the present invention is shown. In flat plug connector assembly 100, flat plug connector 1 is connected to a mating plug connector 20. Mating plug connector 20 is illustrated as a forked spring contact in FIGS. 5 and 6. Blade contact section 11 of flat contact 10 is held clamped here by two pairs of contact springs 22 of forked spring contact 20.

Due to the decoupling brought about by spring arms 12, 13, stresses acting on contact chamber 30 are not transmitted, or are transmitted at least to a significantly reduced extent, to the connection between flat contact 10 and forked spring contact 20, thus reducing the risk of the occurrence of friction corrosion at blade contact 11 of flat contact 10, the pairs of contact springs 22 of forked spring contact, and solder pins 24 of forked spring contact 20.

LIST OF REFERENCE NUMERALS

1 flat plug-in (or plug) connector
10 flat contact
11 blade contact section (blade contact) of flat contact
12, 13 spring arms of flat contact
14, 15 detent hooks (latching hooks; locking hooks) of spring arms
16 metal strip of flat contact
17 line-contacting section of flat contact
19 narrow sides of metal strip of flat contact
20 forked spring contact (mating plug connector)
22 pair of contact springs of forked spring contact
24 solder pins of forked spring contact
30 contact chamber
34, 35 detent recesses (latching recesses; locking recesses) of contact chamber
36, 37 free spaces between detent hooks of flat contact and detent recesses of contact chamber
40, 41, 42, 43 bend-like curves of spring arms
46, 47 attachment sites (molding points) between spring arms of flat contact and metal strip of flat contact
50 connection line
100 flat plug-in (or plug) connector assembly While exemplary embodiments are described above, it is not intended that these embodiments describe all possible forms of the present invention. Rather, the words used in the specification are words of description rather than limitation, and it is understood that various changes may be made without departing from the spirit and scope of the present invention. Additionally, the features of various implementing embodiments may be combined to form further embodiments of the present invention.

What is claimed is:

1. A flat plug-in connector assembly, comprising:

a flat contact including a middle strip having opposite first and second sides and further having a first end that forms a blade contact section;

a mating plug connector including a pair of contact springs for accommodating the blade contact section;

a contact chamber;

the flat contact further including first and second spring arms for damping relative movements between the blade contact section and the contact springs; and wherein the first and second spring arms are integrally formed in one piece at the first and second sides of the flat contact;

the first and second spring arms have first and second free end sections having first and second detent hooks;

the flat contact is inserted in the contact chamber with the first and second detent hooks being displaceably supported in the contact chamber;

the first and second sides of the flat contact extend in a longitudinal direction;

the first and second spring arms of the flat contact extend substantially parallel to the longitudinal direction; and the first and second spring arms of the flat contact each form at least two bend-like curves along their longitudinal extensions.

2. The flat plug-in connector assembly of claim 1 wherein:

the flat contact is formed as a one-piece punched part made of metal.

3. The flat plug-in connector assembly of claim 1 wherein:

the flat contact further includes a second end opposite the first end, the second end forming a line contacting section.

4. The flat plug-in connector assembly of claim 1 wherein:

the flat contact is mechanically connected to the contact chamber only via the detent hooks of the spring arms of the flat contact while the flat contact is inserted in the contact chamber.

5. The flat plug-in connector assembly of claim 4 wherein:

the contact chamber includes first and second detent recesses; and the first and second detent hooks of the springs arms of the flat contact engage with the first and second detent recesses of the contact chamber for the flat contact to be mechanically connected to the contact chamber.

6. The flat plug-in connector assembly of claim 5 wherein:

the first and second detent hooks are displaceably supported within the first and second detent recesses of the contact chamber while being engaged with the first and second detent recesses.

7. The flat plug-in connector assembly of claim 5 wherein:

the first and second detent hooks of the spring arms of the flat contact are movably situated in the longitudinal direction in first and second free spaces between the first and second detent hooks and the first and second detent recesses of contact chamber.

8. The flat plug-in connector assembly of claim 1 wherein:

the first and second spring arms are integrally formed in one piece onto the first and second sides of the flat contact at first and second attachment sites.

9. The flat plug-in connector assembly of claim 8 wherein:

the first and second attachment sites are situated at a same height with one another relative to a longitudinal direction of the middle strip of the flat contact.

10. The flat plug-in connector assembly of claim 9 wherein:

the first and second spring arms of the flat contact are situated mirror-symmetrically with respect to the longitudinal direction of the middle strip of the flat contact.

11. A flat contact for a flat plug-in connector assembly, comprising:

a middle strip having first and second sides and a first end, the first end forming a blade contact section;

first and second spring arms integrally formed in one piece at the first and second sides of the flat contact; and wherein the first and second spring arms have first and second free end sections in a form of first and second detent hooks;

the first and second sides of the flat contact extend in a longitudinal direction;

the first and second spring arms of the flat contact extend substantially parallel to the longitudinal direction; and the first and second spring arms of the flat contact each form at least two bend-like curves along their longitudinal extensions.

12. The flat contact of claim 11 wherein:

the flat contact is formed as a one-piece punched part made of metal.

13. The flat contact of claim 11 wherein:

the flat contact further includes a second end opposite the first end, the second end forming a line contacting section.

14. The flat contact of claim 11 wherein:

the first and second spring arms are integrally formed in one piece onto the first and second sides of the flat contact at first and second attachment sites.

15. The flat contact of claim 14 wherein:

the first and second attachment sites are situated at a same height with one another relative to a longitudinal direction of the middle strip of the flat contact.

16. The flat contact of claim 15 wherein:

the first and second spring arms of the flat contact are situated mirror-symmetrically with respect to the longitudinal direction of the middle strip of the flat contact.

17. A flat plug-in connector assembly, comprising:

a flat contact including a middle strip having opposite first and second sides and further having a first end that forms a blade contact section;

a mating plug connector including a pair of contact springs for accommodating the blade contact section;

a contact chamber;

the flat contact further including first and second spring arms for damping relative movements between the blade contact section and the contact springs; and wherein the first and second spring arms are integrally formed in one piece at the first and second sides of the flat contact;

the first and second spring arms have first and second free end sections having first and second detent hooks;

the flat contact is inserted in the contact chamber with the first and second detent hooks being displaceably supported in the contact chamber;

the flat contact is mechanically connected to the contact chamber only via the detent hooks of the spring arms of the flat contact while the flat contact is inserted in the contact chamber;

the contact chamber includes first and second detent recesses;

the first and second detent hooks of the springs arms of the flat contact engage with the first and second detent recesses of the contact chamber for the flat contact to be mechanically connected to the contact chamber; and the first and second detent hooks are displaceably supported within the first and second detent recesses of the contact chamber while being engaged with the first and second detent recesses.

18. The flat plug-in connector assembly of claim 17 wherein:

the flat contact is formed as a one-piece punched part made of metal.

19. The flat plug-in connector assembly of claim 17 wherein:

the flat contact further includes a second end opposite the first end, the second end forming a line contacting section.

20. The flat plug-in connector assembly of claim 17 wherein:

the first and second spring arms are integrally formed in one piece onto the first and second sides of the flat contact at first and second attachment sites.

* * * * *